US007176469B2

(12) United States Patent
Leung et al.

(10) Patent No.: US 7,176,469 B2
(45) Date of Patent: Feb. 13, 2007

(54) NEGATIVE ION SOURCE WITH EXTERNAL RF ANTENNA

(75) Inventors: Ka-Ngo Leung, Hercules, CA (US); Sami K. Hahto, Albany, CA (US); Sari T. Hahto, Albany, CA (US)

(73) Assignee: The Regents of the University of California, Oakland, CA (US)

( * ) Notice: Subject to any disclaimer, the term of this patent is extended or adjusted under 35 U.S.C. 154(b) by 196 days.

(21) Appl. No.: 10/656,848

(22) Filed: Sep. 6, 2003

(65) Prior Publication Data

US 2004/0104683 A1 Jun. 3, 2004

Related U.S. Application Data

(63) Continuation-in-part of application No. 10/443,575, filed on May 22, 2003.

(60) Provisional application No. 60/382,674, filed on May 22, 2002.

(51) Int. Cl.

| | |
|---|---|
| ***H01J 27/00*** | (2006.01) |
| ***H01J 7/24*** | (2006.01) |
| ***H05B 31/26*** | (2006.01) |
| ***C23C 16/00*** | (2006.01) |
| ***C23F 1/00*** | (2006.01) |

(52) U.S. Cl. ..... 250/423; 315/111.81; 250/424; 118/723 CB; 118/723 I; 156/345.48

(58) Field of Classification Search ..... 118/723 CB, 118/723 FI; 156/345.48
See application file for complete search history.

(56) References Cited

U.S. PATENT DOCUMENTS

| | | | |
|---|---|---|---|
| 2,769,096 | A | 10/1956 | Frey |
| 2,983,834 | A | 5/1961 | Rieffel |
| 3,015,032 | A | 12/1961 | Hoyer |
| 3,113,213 | A | 12/1963 | Brinkerhoff |
| 3,258,402 | A | 6/1966 | Farnsworth |
| 3,417,245 | A | 12/1968 | Schmidt |
| 3,609,369 | A | 9/1971 | Croitoru |
| 3,664,960 | A | 5/1972 | Wood |

(Continued)

FOREIGN PATENT DOCUMENTS

JP 2000133497 A * 5/2000

OTHER PUBLICATIONS

Lomer, P.D.; Bounden, J.E.; Wood, J.D.L.H., "High Output Neutron Generating Tubes," CONF-650405-2. Services Electronics Rsrch Lab (Baldock, England), p. 623-34, (Sep. 1, 1964).

(Continued)

*Primary Examiner*—Parviz Hassanzadeh
*Assistant Examiner*—Rakesh Dhingra
(74) *Attorney, Agent, or Firm*—Joseph R. Milner, Esq.

(57) ABSTRACT

A radio frequency (RF) driven plasma ion source has an external RF antenna, i.e. the RF antenna is positioned outside the plasma generating chamber rather than inside. The RF antenna is typically formed of a small diameter metal tube coated with an insulator. An external RF antenna assembly is used to mount the external RF antenna to the ion source. The RF antenna tubing is wound around the external RF antenna assembly to form a coil. The external RF antenna assembly is formed of a material, e.g. quartz, which is essentially transparent to the RF waves. The external RF antenna assembly is attached to and forms a part of the plasma source chamber so that the RF waves emitted by the RF antenna enter into the inside of the plasma chamber and ionize a gas contained therein. The plasma ion source is typically a multi-cusp ion source. A converter can be included in the ion source to produce negative ions.

12 Claims, 8 Drawing Sheets

U.S. PATENT DOCUMENTS

| | | | | | |
|---|---|---|---|---|---|
| 3,846,636 | A | | 11/1974 | Zehr et al. | 250/499 |
| 4,076,990 | A | | 2/1978 | Hendry | |
| 4,290,847 | A | | 9/1981 | Johnson | |
| 4,395,631 | A | | 7/1983 | Salisbury | 250/251 |
| 4,447,732 | A | | 5/1984 | Leung et al. | 250/427 |
| 4,529,571 | A | | 7/1985 | Bacon et al. | 376/144 |
| 4,602,161 | A | * | 7/1986 | Whealton et al. | 250/423 R |
| 4,649,279 | A | * | 3/1987 | Delmore | 250/427 |
| 4,654,561 | A | | 3/1987 | Shelton | |
| 4,725,449 | A | | 2/1988 | Ehlers et al. | 427/49 |
| 4,793,961 | A | | 12/1988 | Ehlers et al. | 376/127 |
| 4,806,829 | A | | 2/1989 | Nakao | |
| 4,935,194 | A | | 6/1990 | Verschoore | |
| 4,977,352 | A | | 12/1990 | Williamson | |
| 5,008,800 | A | | 4/1991 | Klinkowstein | |
| 5,053,184 | A | | 10/1991 | Cluzeau | |
| 5,135,704 | A | | 8/1992 | Shefer | |
| 5,162,699 | A | * | 11/1992 | Tokoro et al. | 315/111.81 |
| 5,198,677 | A | * | 3/1993 | Leung et al. | 250/424 |
| 5,215,703 | A | | 6/1993 | Berdardet | |
| 5,434,353 | A | | 7/1995 | Kraus | 174/15.6 |
| 5,581,156 | A | * | 12/1996 | Roberts et al. | 315/111.81 |
| 5,587,226 | A | | 12/1996 | Leung et al. | 428/210 |
| 5,745,536 | A | | 4/1998 | Brainard | |
| 5,763,851 | A | * | 6/1998 | Forster et al. | 219/121.43 |
| 5,969,470 | A | | 10/1999 | Druz | |
| 6,094,012 | A | | 7/2000 | Leung et al. | 315/111.81 |
| 6,124,834 | A | | 9/2000 | Leung et al. | 343/867 |
| 6,141,395 | A | | 10/2000 | Nishimura | |
| 6,184,625 | B1 | | 2/2001 | Ogura | |
| 6,228,176 | B1 | * | 5/2001 | Chu et al. | 118/728 |
| 6,376,978 | B1 | | 4/2002 | Leung et al. | 313/359.1 |
| 6,464,891 | B1 | * | 10/2002 | Druz et al. | 216/67 |
| 6,511,575 | B1 | * | 1/2003 | Shindo et al. | 204/298.34 |
| 6,761,796 | B2 | * | 7/2004 | Srivastava et al. | 156/345.38 |
| 6,768,120 | B2 | * | 7/2004 | Leung et al. | 250/423 R |
| 6,777,699 | B1 | * | 8/2004 | Miley et al. | 250/492.3 |
| 6,925,137 | B1 | | 8/2005 | Forman | |
| 2002/0072016 | A1 | * | 6/2002 | Chen et al. | 430/323 |
| 2002/0150193 | A1 | | 10/2002 | Leung et al. | 376/108 |

OTHER PUBLICATIONS

Eyrich, W., Schmidt, A., "Two Compact, High-Intensity Pulsed Neutron Sources," Technical Report No. KFK-304; SM-62/4; SM-62/4, Federal Republic of Germany (Germany), p. 589-608, (May 1, 1965).

Lomer, P.D., Bounden, J.E.; Wood, J.D.L.H., "A Neutron Tube with Constant Output." Nucl. Instr. Methods, Services Electronics Resrch Lab (Baldock, England), p. 283-288, (Mar. 1, 1965).

* cited by examiner

NEGATIVE ION SOURCE WITH EXTERNAL RF ANTENNA

RELATED APPLICATIONS

This application is a continuation-in-part (CIP) of Ser. No. 10/443,575 filed May 22, 2003, which claims priority of Provisional Application Ser. No. 60/382,674 filed May 22, 2002, which are herein incorporated by reference.

GOVERNMENT RIGHTS

The United States Government has the rights in this invention pursuant to Contract No. DE-AC03-76SF00098 between the United States Department of Energy and the University of California.

BACKGROUND OF THE INVENTION

The invention relates to radio frequency (RF) driven plasma ion sources, and more particularly to the RF antenna and the plasma chamber, and most particularly to an ion source with a sputtering converter to produce negative ions.

A plasma ion source is a plasma generator from which beams of ions can be extracted. Multi-cusp ion sources have an arrangement of magnets that form magnetic cusp fields to contain the plasma in the plasma chamber. Plasma can be generated in a plasma ion source by DC discharge or RF induction discharge. An ion plasma is produced from a gas which is introduced into the chamber. The ion source also includes an extraction electrode system at its outlet to electrostatically control the passage of ions from the plasma out of the plasma chamber. Both positive and negative ions can be produced, as well as electrons.

Integrated circuit technology utilizes semiconductor materials which are doped with small amounts of impurities to change conductivity. The most common p-type dopant is boron, and common n-type dopants are phosphorus and arsenic. Negative ions have advantages over positive ions in ion implantation, e.g. preventing charging of the target. Furthermore, most existing ion beam implanter machines use the very toxic $BF_3$ gas to form positive boron ions. Thus a plasma ion source of negative ions would be useful for semiconductor applications. It is also advantageous, particularly for low energy beams to form shallow junctions, to implant molecular ions instead of atomic ions, e.g. $B_2^-$ or $B_3^-$ instead of $B^-$ to reduce space charge effects during transport of the beam. A higher energy molecular ion beam will have the same energy per atom as a lower energy atomic ion beam.

One method of producing negative ions in a plasma ion source is to include a converter in a source of positive ions for surface production of negative ions. One mechanism for negative ion production is sputtering surface ionization. The converter is made of the material to be ionized. A background plasma is formed of a heavy gas, usually argon or xenon. The converter is biased to about 0.5–1 kV negative potential with respect to the ion source walls and plasma. The positive ions from the plasma are accelerated through the plasma sheath and strike the converter. This results in ejection or "sputtering" of particles from the surface. If the work function of the converter material is low, some of the sputtered atoms are converted into negative ions in the surface and are accelerated through the sheath. RF surface sputtering ion sources have been built, but they use cesium to increase the negative ion yields to acceptable levels, and cesium is a difficult material to use. Thus a non-cesiated RF sputter ion source would be desirable.

Unlike the filament DC discharge where eroded filament material can contaminate the chamber, RF discharges generally have a longer lifetime and cleaner operation. In a RF driven source, an induction coil or antenna is placed inside the ion source chamber and used for the discharge. However, there are still problems with internal RF antennas for plasma ion source applications.

The earliest RF antennas were made of bare conductors, but were subject to arcing and contamination. The bare antenna coils were then covered with sleeving material made of woven glass or quartz fibers or ceramic, but these were poor insulators. Glass or porcelain coated metal tubes were subject to differential thermal expansion between the coating and the conductor, which could lead to chipping and contamination. Glass tubes form good insulators for RF antennas, but in a design having a glass tube containing a wire or internal surface coating of a conductor, coolant flowing through the glass tube is subject to leakage upon breakage of the glass tube, thereby contaminating the entire apparatus in which the antenna is mounted with coolant. A metal tube disposed within a glass or quartz tube is difficult to fabricate and only has a few antenna turns.

U.S. Pat. Nos. 4,725,449; 5,434,353; 5,587,226; 6,124,834; 6,376,978 describe various internal RF antennas for plasma ion sources, and are herein incorporated by reference.

SUMMARY OF THE INVENTION

Accordingly, it is an object of the invention to provide an improved plasma ion source that eliminates the problems of an internal RF antenna.

It is also an object of the invention to provide a source of negative ions using a sputtering converter.

The invention is a radio frequency (RF) driven plasma ion source with an external RF antenna, i.e. the RF antenna is positioned outside the plasma generating chamber rather than inside. The RF antenna is typically formed of a small diameter metal tube coated with an insulator. Two flanges are used to mount the external RF antenna assembly to the ion source. The RF antenna tubing is wound around an open inner cylinder to form a coil. The external RF antenna assembly is formed of a material, e.g. quartz, which is essentially transparent to the RF waves. The external RF antenna assembly is attached to and forms a part of the plasma source chamber so that the RF waves emitted by the RF antenna enter into the inside of the plasma chamber and ionize a gas contained therein. The plasma ion source is typically a multi-cusp ion source. A particular embodiment of the ion source with external antenna includes a sputtering converter for production of negative ions. A $LaB_6$ converter can be used for boron ions.

DETAILED DESCRIPTION OF THE INVENTION

The principles of plasma ion sources are well known in the art. Conventional multicusp plasma ion sources are illustrated by U.S. Pat. Nos. 4,793,961; 4,447,732; 5,198,677; 6,094,012, which are herein incorporated by reference.

Figure 1:
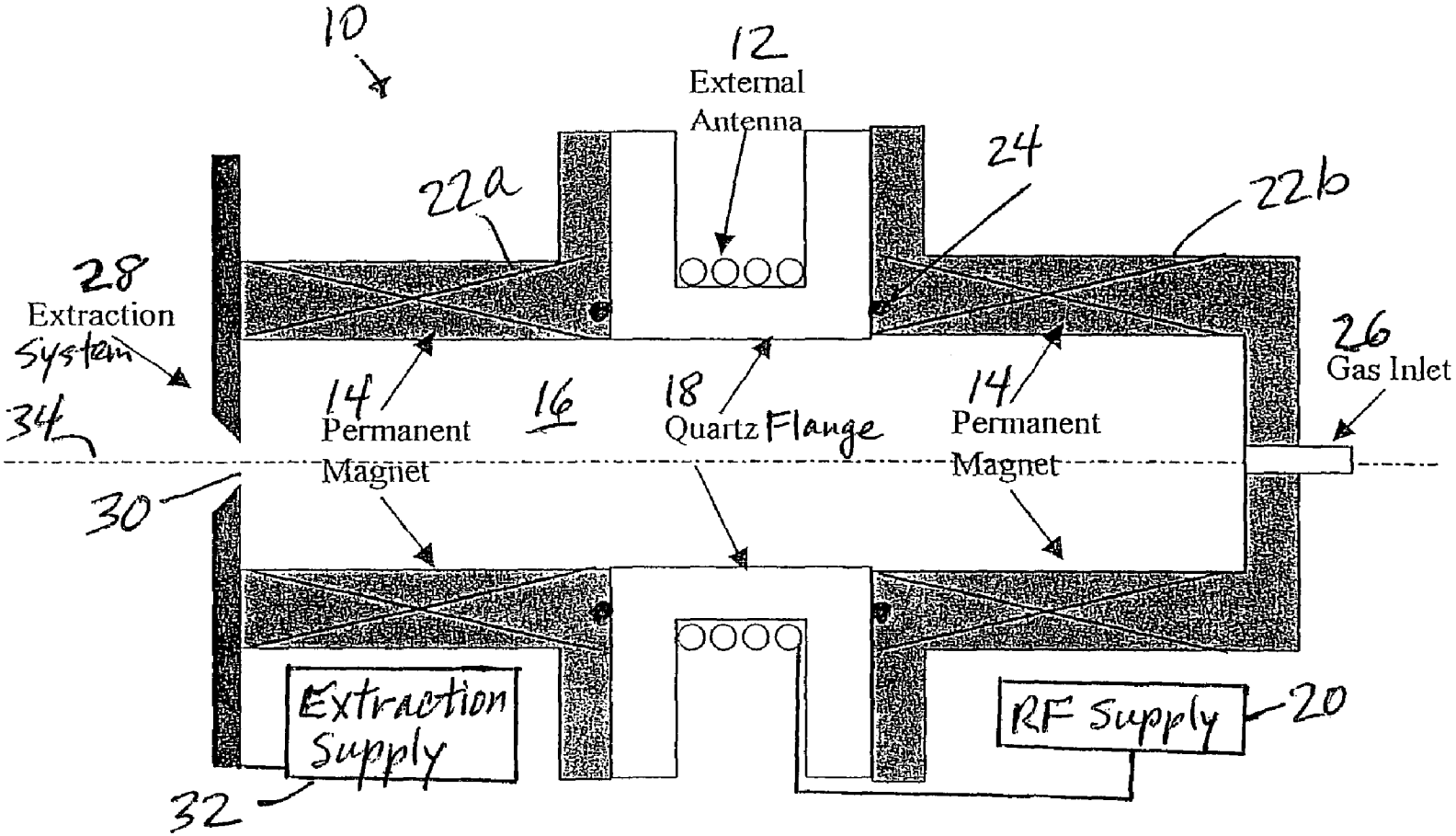
FIGS. 1–5 are side cross sectional views of various embodiments of a plasma ion source with an external RF antenna according to the invention.

A plasma ion source 10, which incorporates an external RF antenna 12, is illustrated in FIG. 1. Plasma ion source 10 is preferably a multi-cusp ion source having a plurality of permanent magnets 14 arranged with alternating polarity around a source chamber 16, which is typically cylindrical in shape. External antenna 12 is wound around external RF antenna assembly 18 and electrically connected to a RF power source 20 (which includes suitable matching circuits), typically 2 MHz or 13.5 MHz. The external RF antenna assembly 18 is made of a material such as quartz that easily transmits the RF waves. The external RF antenna assembly 18 is mounted between two plasma chamber body sections 22*a*, 22*b*, typically with O-rings 24 providing a seal. Chamber body sections 22*a*, 22*b* are typically made of metal or other material that does not transmit RF waves therethrough. The chamber body sections 22*a*, 22*b* and the external RF antenna assembly 18 together define the plasma chamber 16 therein. Gas inlet 26 in (or near) one end of chamber 16 allows the gas to be ionized to be input into source chamber 16.

The opposed end of the ion source chamber 16 is closed by an extractor 28 which contains a central aperture 30 through which the ion beam can pass or be extracted by applying suitable voltages from an associated extraction power supply 32. Extractor 28 is shown as a simple single electrode but may be a more complex system, e.g. formed of a plasma electrode and an extraction electrode, as is known in the art. Extractor 28 is also shown with a single extraction aperture 30 but may contain a plurality of apertures for multiple beamlet extraction.

In operation, the RF driven plasma ion source 10 produces ions in source chamber 16 by inductively coupling RF power from external RF antenna 12 through the external RF antenna assembly 18 into the gas in chamber 16. The ions are extracted along beam axis 34 through extractor 28. The ions can be positive or negative; electrons can also be extracted.

FIGS. 2–5 show variations of the plasma ion source shown in FIG. 1. Common elements are the same and are not described again or even shown again. Only the differences or additional elements are further described.

Figure 2:
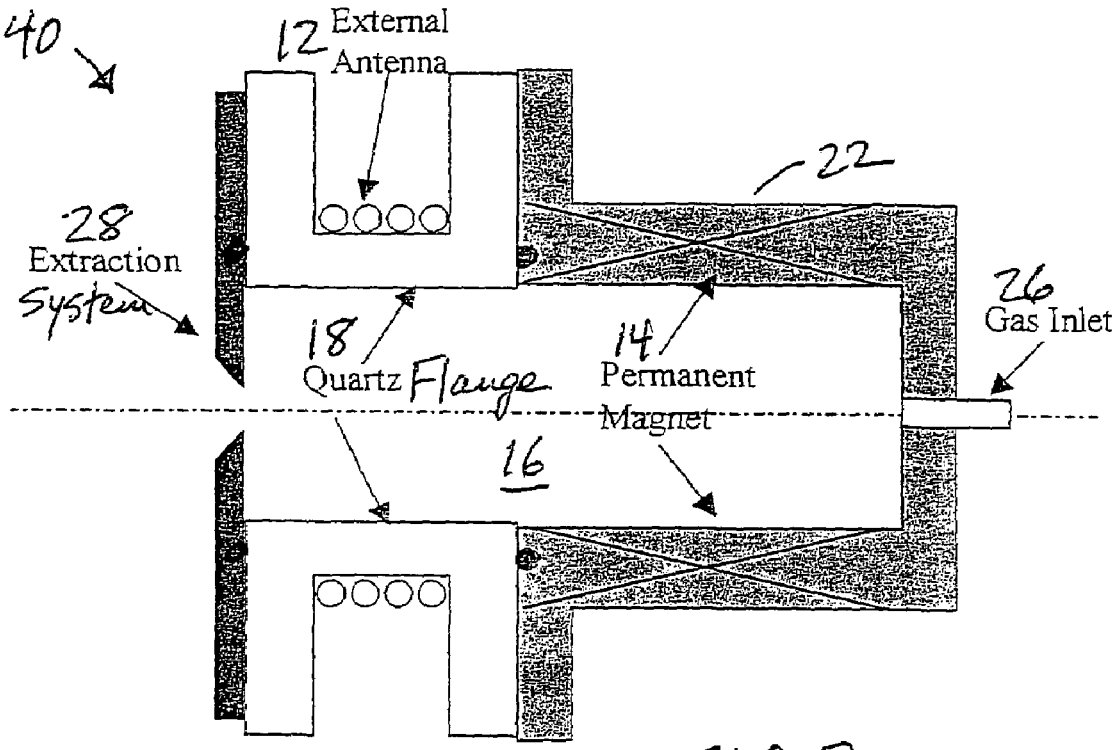

Plasma ion source 40, shown in FIG. 2, is similar to plasma ion source 10 of FIG. 1, except that the external RF antenna assembly 18 with external antenna 12 is mounted to one end of a single plasma chamber body section 22 instead of between two body sections 22*a*, 22*b*. The chamber body section 22 and the external RF antenna assembly 18 together define the plasma chamber 16 therein. The extractor 28 is mounted directly to the external RF antenna assembly 18 in place of the second body section so that external RF antenna assembly 18 is mounted between body section 22 and extractor 30.

Figure 3:
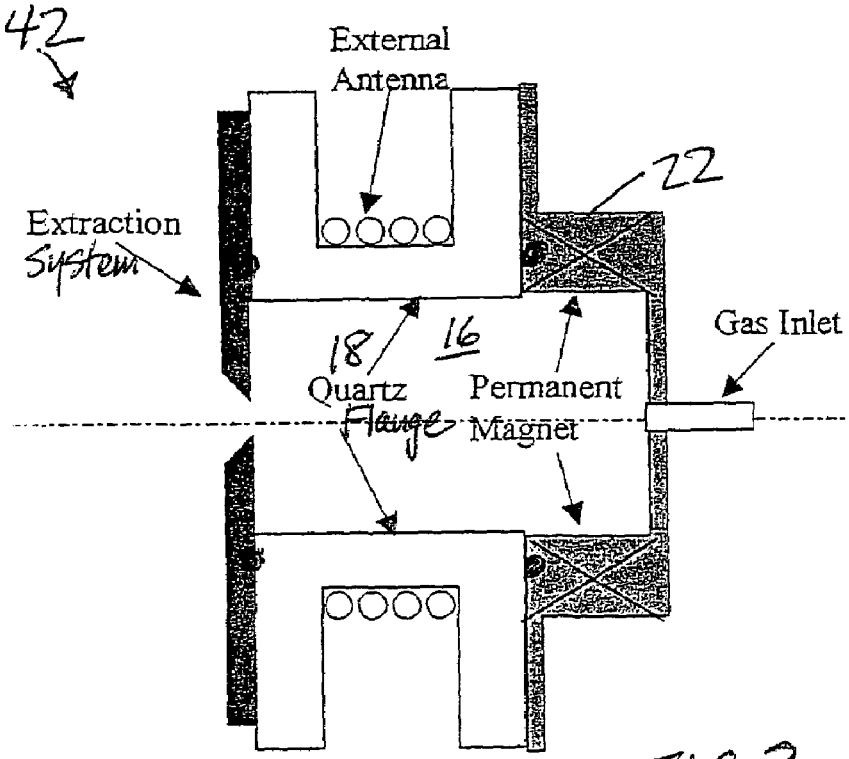

Plasma ion source 42, shown in FIG. 3, is similar to plasma ion source 40 of FIG. 2, with external RF antenna assembly 18 with external antenna 12 mounted to the end of a single plasma chamber body section 22. However, ion source 42 is much more compact than ion source 40 since the chamber body section 22 is much shorter, i.e. chamber 16 is much shorter. In FIG. 2, the length of chamber body section 22 is much longer than the length of the external RF antenna assembly 12 while in FIG. 3 it is much shorter. Such a short ion source is not easy to achieve with an internal antenna.

Figure 4:
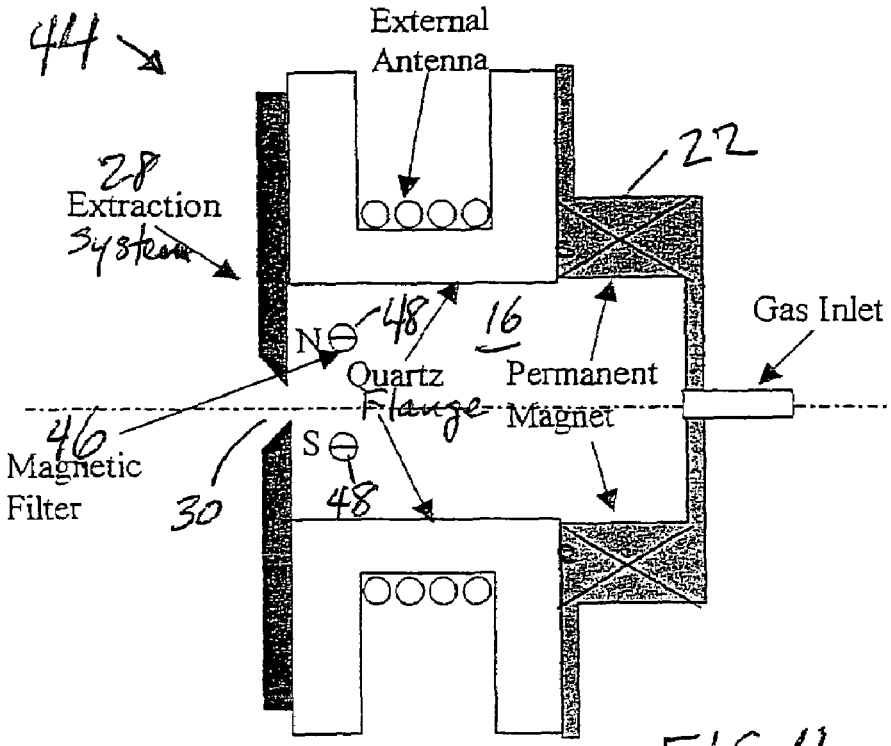

Plasma ion source 44, shown in FIG. 4, is similar to plasma ion source 42 of FIG. 3. A permanent magnet filter 46 formed of spaced magnets 48 is installed in the source chamber 16 of plasma ion source 44, adjacent to the extractor 28 (in front of aperture 30). Magnetic filter 46 reduces the energy spread of the extracted ions and enhances extraction of atomic ions.

Figure 5:
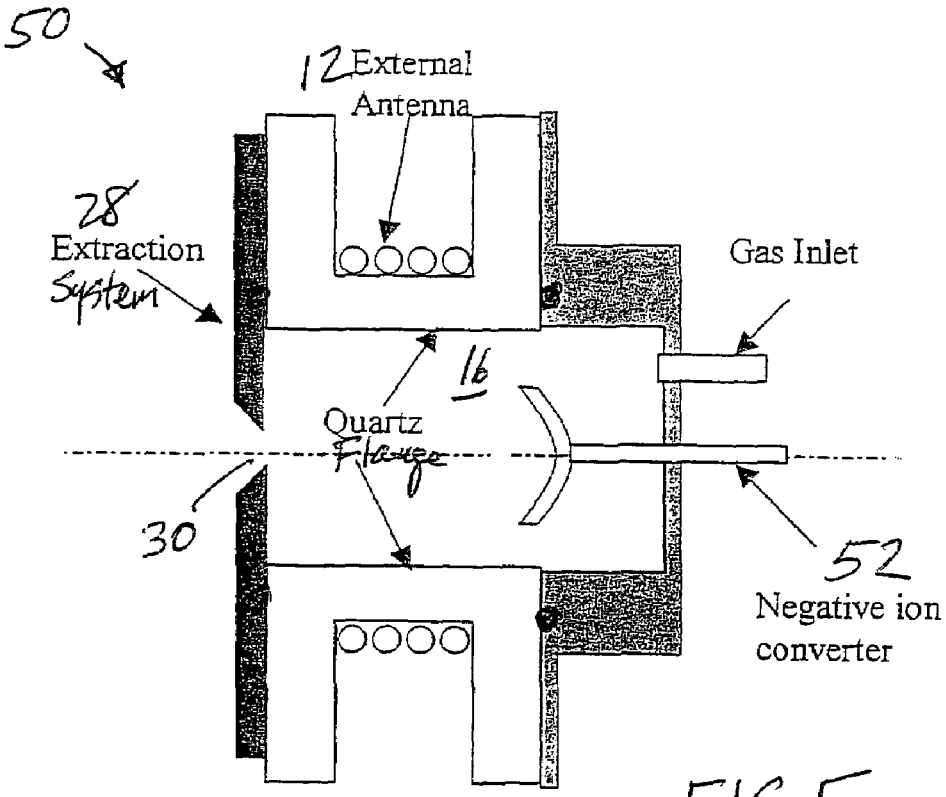

Plasma ion source 50, shown in FIG. 5, is similar to plasma ion source 42 of FIG. 3, but is designed for negative ion production. An external antenna arrangement is ideal for surface conversion negative ion production. A negative ion converter 52 is placed in the chamber 16. Antenna 12 is located between the converter 52 and aperture 30 of extractor 28. Dense plasma can be produced in front of the converter surface. The thickness of the plasma layer can be optimized to reduce the negative ion loss due to stripping.

Figures 6A, 6B:
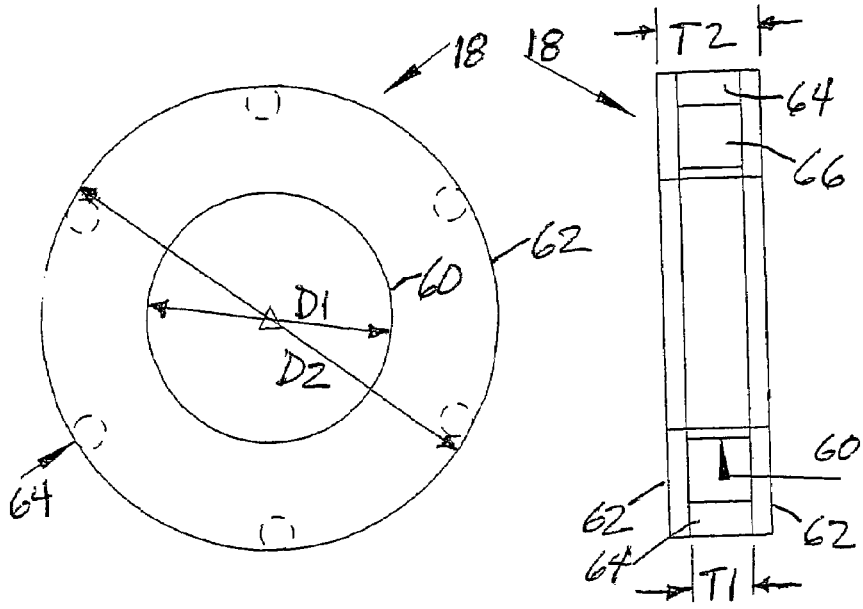
FIGS. 6A, B are end and side views of an external RF assembly for mounting an external RF antenna to a plasma ion source according to the invention.

FIGS. 6A, B illustrate the structure of an external RF antenna assembly 18 of FIGS. 1–5 for housing and mounting an external antenna to a plasma ion source. The external RF antenna assembly 18 is formed of an open inner cylinder 60 having an inner diameter D1 and a pair of flanges 62 attached to the ends of cylinder 60 and extending outward (from inner diameter D1) to a greater outer diameter D2. Spaced around the outer perimeter of the annular flanges 62 are a plurality of support pins 64 extending between the flanges 62 to help maintain structural integrity. The inner cylinder 60 and extending flanges 62 define a channel 66 in which an RF antenna coil can be wound. The channel 66 has a length T1 and the flange has a total length T2.

The antenna is typically made of small diameter copper tubing (or other metal). A layer of Teflon or other insulator is used on the tubing for electrical insulation between turns. Coolant can be flowed through the coil tubing. If cooling is not needed, insulated wires can be used for the antenna coils. Many turns can be included, depending on the length T1 of the channel and the diameter of the tubing. Multilayered windings can also be used. Additional coils can be added over the antenna coils for other functions, such as applying a magnetic field.

Figure 7:
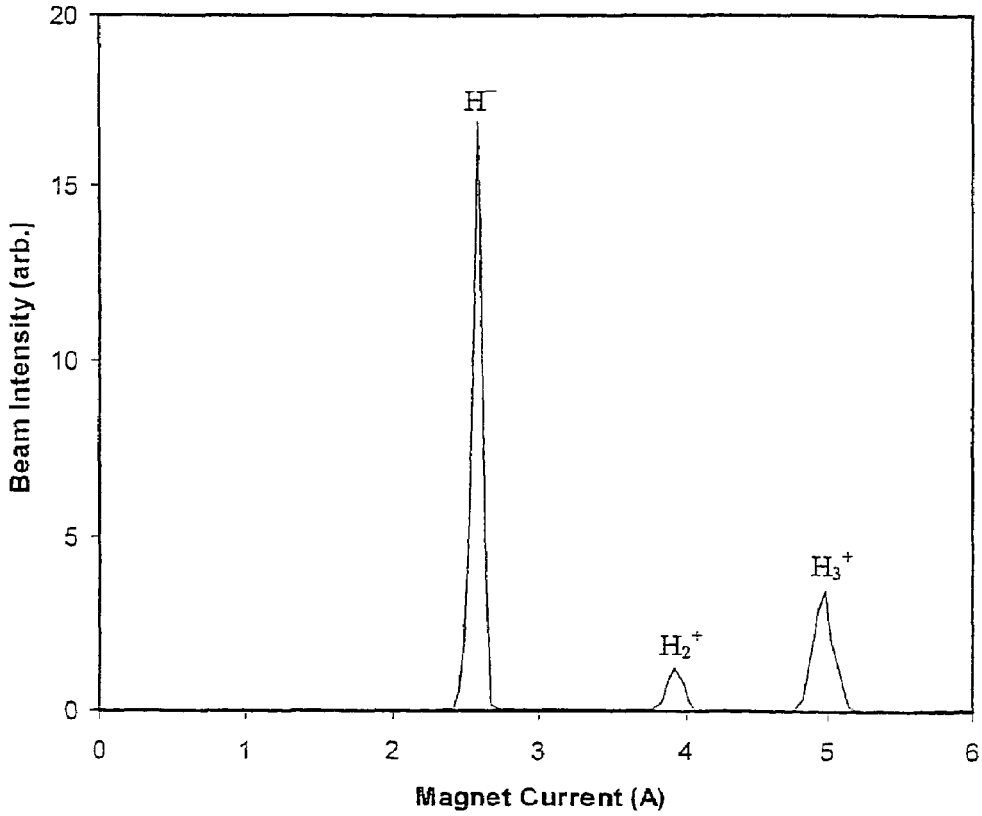
FIG. 7 is a graph of the relative amounts of various hydrogen ion species obtained with an external antenna source of the invention.

FIG. 7 is a graph of the relative amounts of various hydrogen ion species obtained with the source of FIG. 3. More than 75% of the atomic hydrogen ion $H^+$ was obtained with an RF power of 1 kW. The current density is about 50 $mA/cm^2$ at 1 kW of RF input power. The source has been operated with RF input power higher than 1.75 kW.

Figure 8:
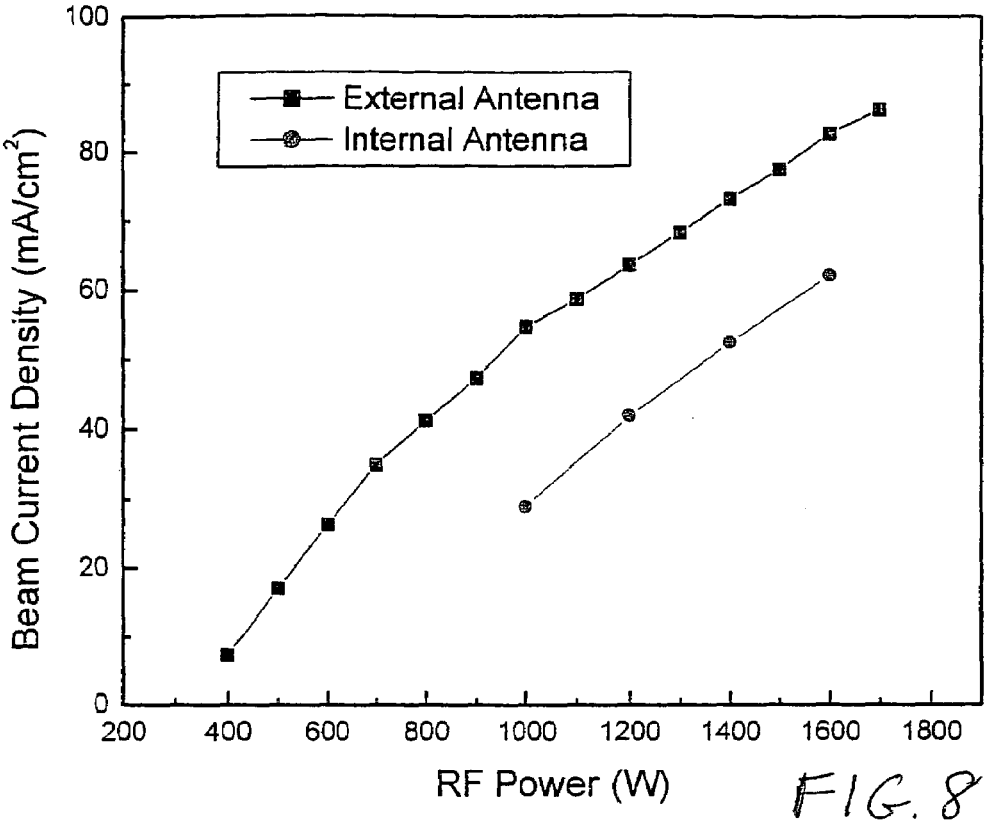
FIG. 8 is a graph of hydrogen ion current density extracted from an external antenna source and from an internal antenna source, at the same extraction voltage.

FIG. 8 is a comparison of hydrogen ion current density extracted from an external antenna source and from an internal antenna source, showing the extracted beam current density from an external antenna and internal antenna generated hydrogen plasma operating at the same extraction voltage. When operating at the same RF input power, the beam current density extracted from the external antenna source is higher than that of the internal antenna source.

Figure 9:
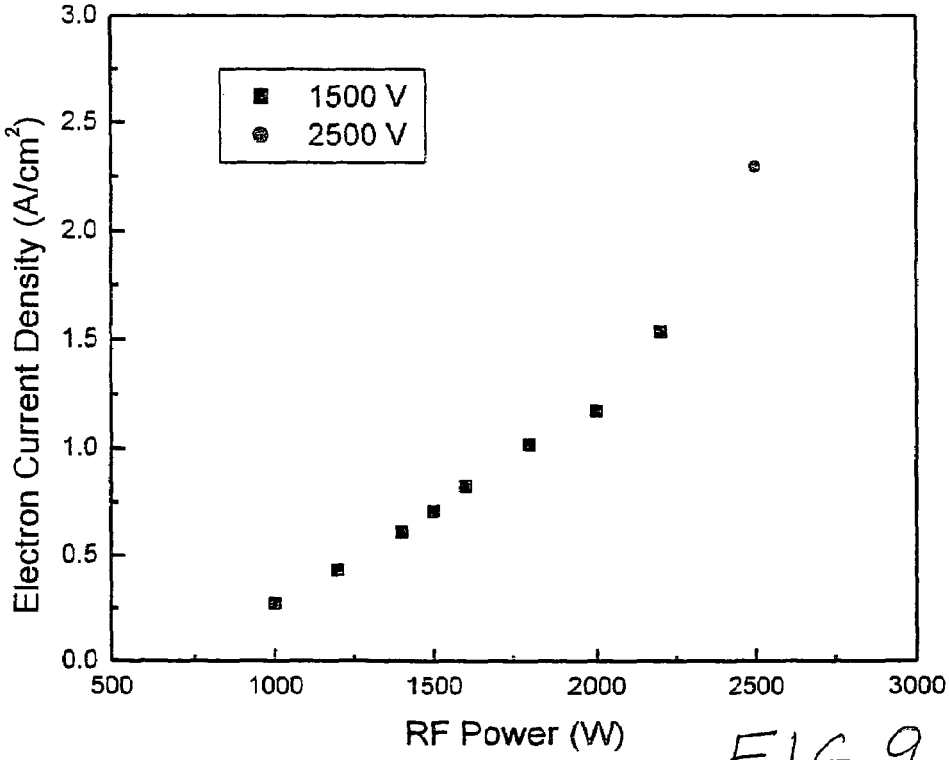
FIG. 9 is a graph of the electron current density produced by an external antenna source.

Simply by changing to negative extraction voltage, electrons can be extracted from the plasma generator using the same column. FIG. 9 shows the electron current density produced by an external antenna source. At an input power of 2500 W, electron current density of 2.5 $A/cm^2$ is achieved at 2500 V, which is about 25 times larger than ion production.

The ion source of the invention with external antenna enables operation of the source with extremely long lifetime. There are several advantages to the external antenna. First, the antenna is located outside the source chamber, eliminating a source of contamination, even if the antenna fails. Any mechanical failure of the antenna can be easily fixed without opening the source chamber. Second, the number of turns in the antenna coil can be large (>3). As a result the discharge can be easily operated in the inductive mode, which is much more efficient than the capacitive mode. The plasma can be operated at low source pressure. The plasma potential is low for the inductive mode. Therefore, sputtering of the metallic chamber wall is minimized. Third, plasma loss to the antenna structure is much reduced, enabling the design of compact ion sources. No ion bombardment of the external antenna occurs, also resulting in longer antenna lifetime.

RF driven ion sources of the invention with external antenna can be used in many applications, including $H^-$ ion production for high energy accelerators, $H^+$ ion beams for ion beam lithography, $D^+/T^+$ ion beams for neutron generation, and boron or phosphorus beams for ion implantation. If electrons are extracted, the source can be used in electron projection lithography.

A source with external antenna is easy to scale from sizes as small as about 1 cm in diameter to about 10 cm in diameter or greater. Therefore, it can be easily adopted as a source for either a single beam or a multibeam system.

Figure 10:
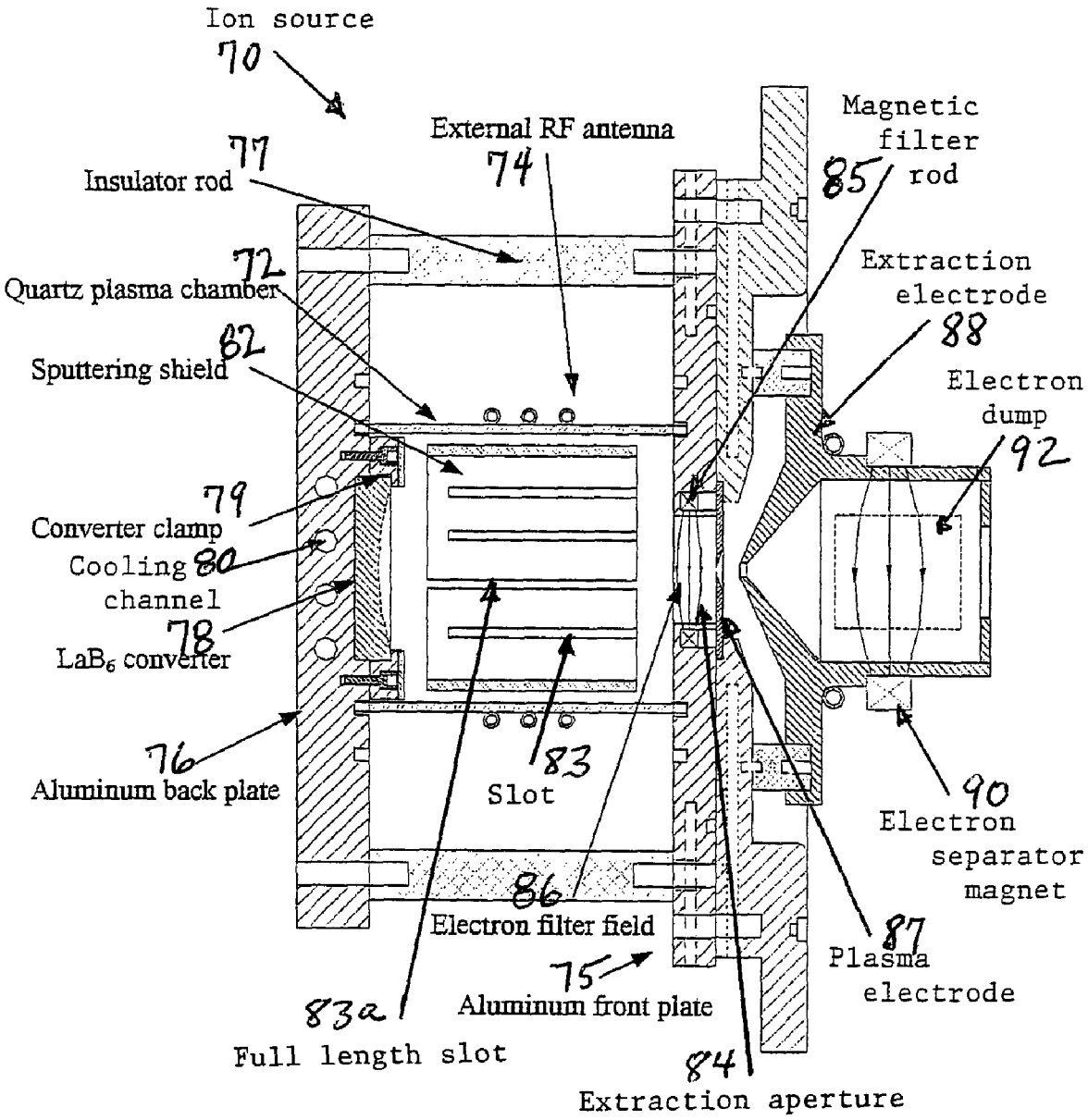
FIG. 10 is a cross-sectional view of a specific embodiment of the plasma ion source with external antenna of the invention with a converter to produce negative ions.

A plasma ion source of the invention using an external antenna and including a negative ion converter which operates on the surface sputtering process is shown generally in FIG. 5. FIG. 10 shows a more detailed specific embodiment of a compact surface production or sputtering negative ion source 70 with external antenna. Ion source 70 is formed of a quartz tube 72, e.g. 80 mm long and 75 mm inside diameter, around which the external RF antenna 74 is wound. The ends of tube 72 sit in o-ring grooves on front and back (aluminum) plates 75, 76. The front and back plates 75, 76 are connected by a plurality of (e.g. 6) insulator rods 77, which also take the mechanical load instead of quartz tube 72. Tube 72 defines the plasma chamber in which a plasma is produced in a gas by external RF antenna 74 connected to a RF supply (not shown).

A lanthanum hexaboride ($LaB_6$) converter 78, e.g. 50 mm diameter, is clamped to the back plate 76 by a stainless steel collar or converter clamp 79, which is shielded from the plasma by an aluminum oxide ring. Cooling channels 80 are formed in back plate 76 to cool converter 78. Converter 78 is negatively biased to attract positive ions from the plasma, and has a spherical curvature. Converter 78 functions as a sputtering target to provide the boron and also as a surface ionizer to convert the neutral boron atoms into negative ions. Other materials can be used, e.g. indium phosphide (InP) can be used for phosphorus ions.

A sputtering shield 82, formed of a quartz cylinder, e.g. 70 mm diameter, with a plurality (e.g. 10) of slots 83, is placed inside plasma tube (chamber) 72. Sputtering shield 82 is not necessary but greatly improves operational lifetime. Material (La and B) sputtered from the converter 78 will cover the walls of plasma chamber (tube) 72. La is a metal so the sputtered layer is conducting. This would create a faraday shield between the RF antenna and the plasma volume, and RF power will be lost into the sputtered layer instead of the plasma. By installing a slotted sputtering shield 82, with one slot 83*a* extending the full length of shield (tube) 82, the formation of a closed conducting layer is prevented, and the RF field is not cancelled out.

Front plate 75 contains an extraction aperture 84. A pair of filter magnet rods 85 are positioned around the extraction aperture 84 and produce an electron filter field 86. Field 86 turns away the secondary electrons emitted from the surface of converter 78. Field 86 also lowers the plasma density in front of the extraction aperture 84 and thus lowers the extracted volume electron current.

As an example, the RF antenna 74 is formed of about 3 loops of a simple 3 mm diameter copper tube with cooling water flowing inside. Two RF frequencies, 13.56 and 27 MHz, have been used. An argon plasma ($Ar^+$ ions) is typically produced in source 70.

An ion extraction system formed of a first or plasma electrode 87 and a second or extraction (puller) electrode 88 which contain aligned apertures, e.g. 2 mm diameter. Ions are extracted by applying an extraction voltage to the electrode 88. To decrease the extracted electron current, the thickness of the plasma electrode 87 can be increased. Other extractor configurations can also be used, as is known in the art. Since the extracted negative ion beam will also include electrons, the extracted beam passes through a separator magnetic field produced by electron separator magnets 90 and the electrons are deflected into an electron dump 92.

The length of ion source chamber 72 is selected so that the distance from the surface of the converter 78 to the extraction aperture 84 matches the radius of curvature of the converter 78, e.g. 75 mm, so that the negative ions will be focused onto the extraction aperture.

Figure 11:
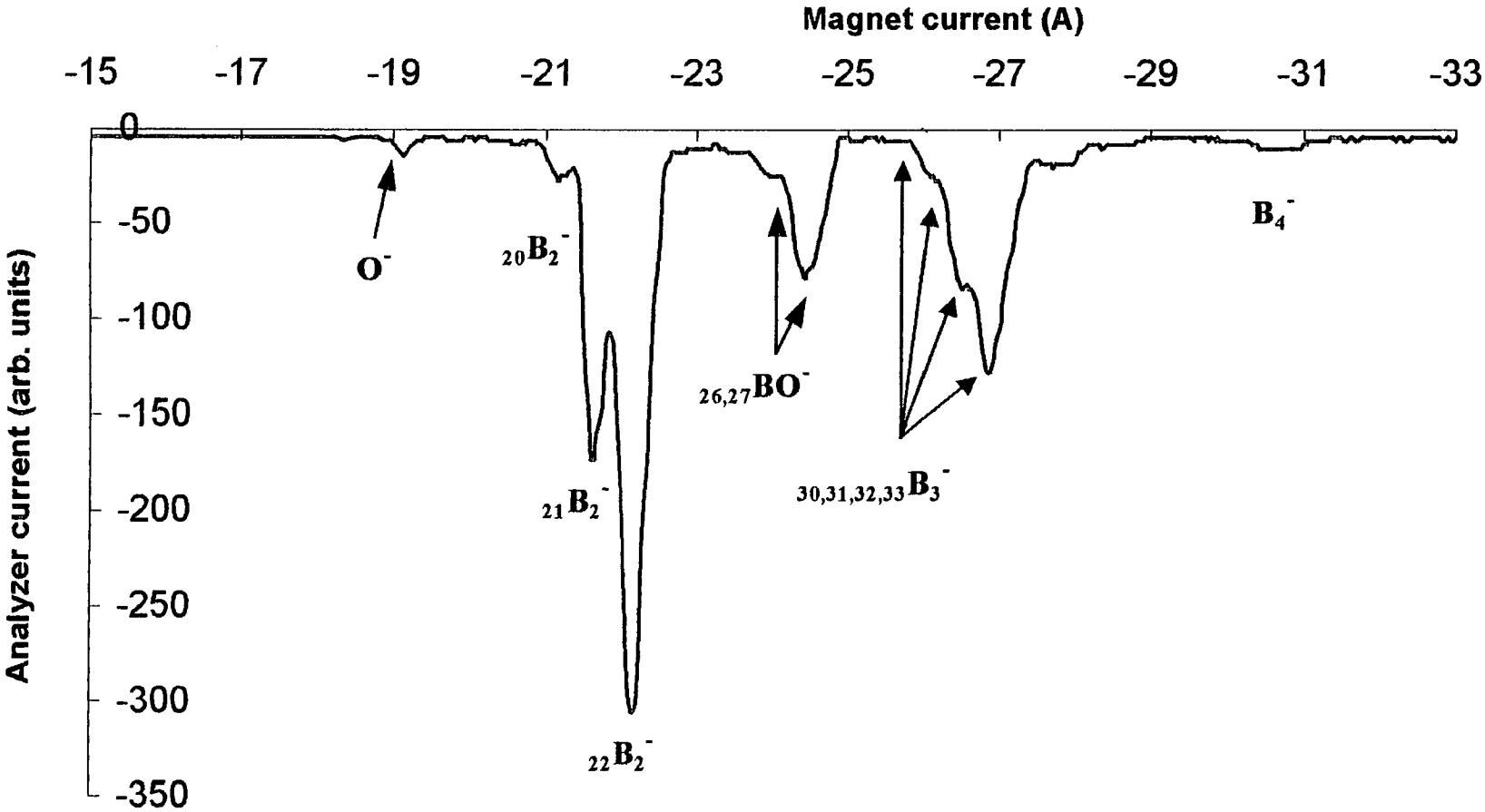
FIG. 11 shows a negative ion spectrum for boron ions from an argon plasma using a sputtering ion source of the invention.
Figure 12:
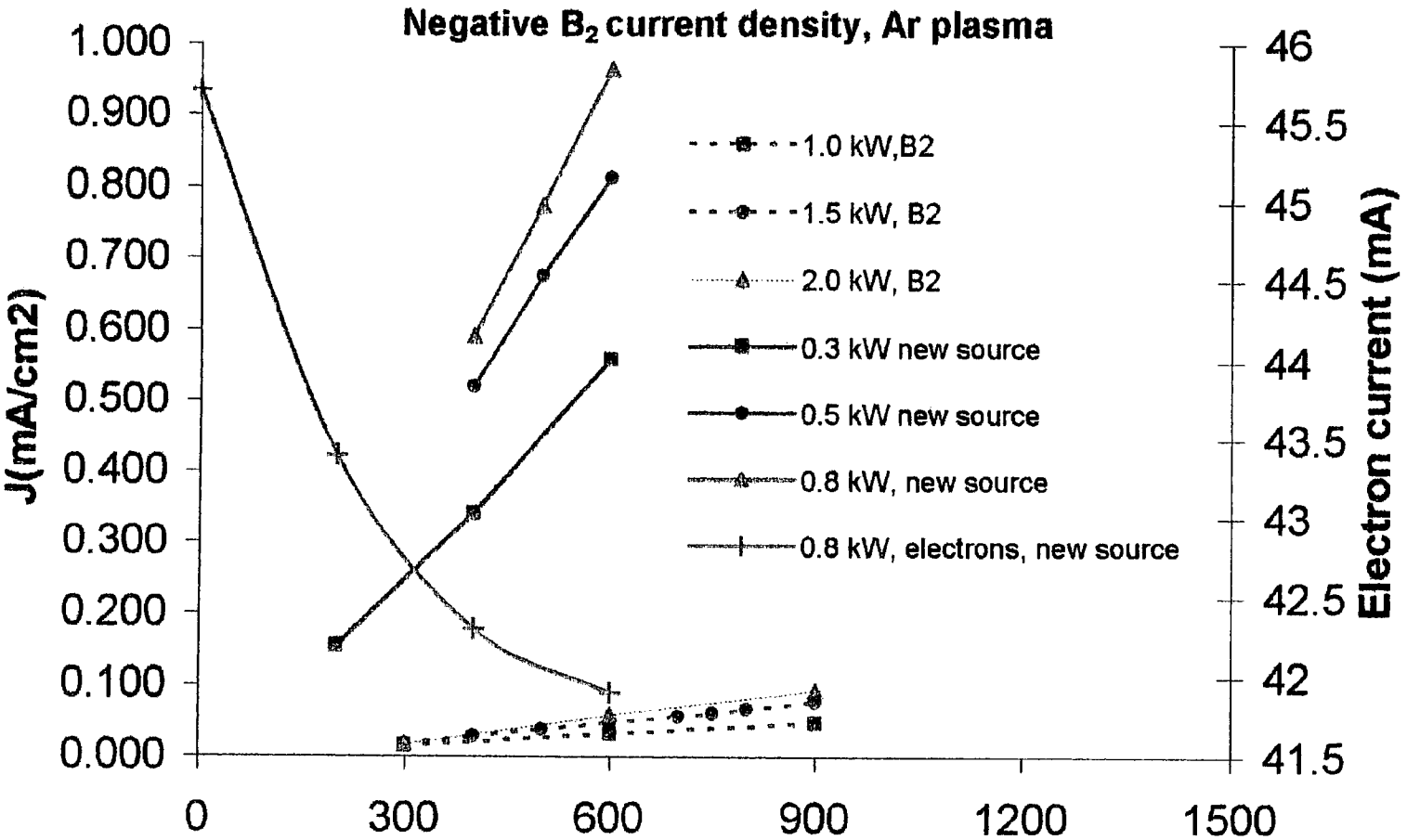
FIG. 12 shows the $B_2^-$ current density as a function of RF power for a sputtering ion source of the invention.

FIG. 11 shows a negative ion spectrum for boron ions from an argon plasma at 300 W RF power, 8 mTorr source pressure, 8 kV extraction voltage, and −400 V converter bias. (These parameters are illustrative; ion sources can be designed with a wide range of operating parameters.) FIG. 12 shows the $B_2^-$ current density as a function of RF power (300, 500, 800 W at 10 mTorr source pressure) for a sputtering ion source of the invention. The $B_2^-$ ion currents are compared to those from a prior art multicusp sputtering ion source with internal antenna. Extracted electron current at 800 W is also shown. The beam fractions stayed the same at different RF power levels and converter voltages: about 62% of the beam was $B_2^-$, 27% was $B_3^-$, and 10% was $BO^-$. The maximum $B_2^-$ current density obtained with the illustrative source was about 1 mA/cm2 at 800 W power, 10 mTorr source pressure, and −600 V converter bias. This compares favorably with present sources using cesium. Larger sources could provide greater current density. Cesium could also be added to increase current.

Accordingly the invention provides a compact surface production or sputtering negative ion source useful in the semiconductor industry, in particular for ion implantation, and other applications. The external antenna and internal sputtering shield provide long lifetime. No cesium or $BF_3$ is used. Relatively high currents of molecular negative ions are produced. In particular, $B_2^-$ and $B_3^-$ ions can be produced from an argon plasma with a $LaB_6$ converter.

Changes and modifications in the specifically described embodiments can be carried out without departing from the scope of the invention which is intended to be limited only by the scope of the appended claims.

The invention claimed is:

1. A plasma ion source for producing negative ions, comprising:

a source chamber;

an RF antenna mounted external to the chamber;

an RF power source coupled to the RF antenna for generating a plasma containing positive ions in a gas in the source chamber;

a converter mounted in the source chamber and negatively biased with respect to the source chamber and plasma, which is a non-cesium containing plasma, the converter being made of a non-cesium containing material and including a converter surface shaped and positioned in the source chamber so the positive ions impact the converter surface and by sputtering surface ionization produce negative ions substantially directed to be moved on or parallel to a longitudinal axis of the source chamber towards an extraction aperture.

2. The plasma ion source of claim 1 wherein the source chamber comprises a quartz tube mounted between a pair of end plates.

3. The plasma ion source of claim 1 wherein the converter is made of $LaB_6$ to produce boron ions.

4. The plasma ion source of claim 3 wherein the plasma generated in the source chamber is an argon ion plasma.

5. The plasma ion source of claim 1 further comprising a cylindrical sputtering shield mounted in the source chamber.

6. The plasma ion source of claim 5 wherein the cylindrical sputtering shield contains a plurality of spaced slots, one of the slots extending the length of the shield.

7. The plasma ion source of claim 1 wherein the RF antenna is formed of a coil of copper or other conducting tubing.

8. The plasma ion source of claim 1 wherein the source chamber further comprises a pair of spaced extraction electrodes mounted at the aperture.

9. The plasma ion source of claim 8 further comprising a magnetic filter mounted at the extraction aperture to reduce extracted electron current.

10. The plasma ion source of claim 9 further comprising a pair of spaced electron separator magnets positioned after the extraction electrodes to deflect electrons.

11. The plasma ion source of claim 8 wherein the converter surface has a spherical curvature with a radius equal to the length of the source chamber for focusing the negative ions on the extraction aperture.

12. The plasma ion source of claim 1 wherein the plasma ion source operates at about 300–800 W RF power, 8–10 mTorr gas pressure, and 0.5–1 kV converter bias.

* * * * *